United States Patent [19]

Bouchillon

[11] Patent Number: 4,696,737

[45] Date of Patent: Sep. 29, 1987

[54] FIBER RECOVERY ELUTRIATING HYDROCYCLONE

[75] Inventor: Charles W. Bouchillon, Starkville, Miss.

[73] Assignee: The Bauer Bros. Co., Springfield, Ohio

[21] Appl. No.: 834,999

[22] Filed: Feb. 28, 1986

[51] Int. Cl.[4] ..... B03D 1/00

[52] U.S. Cl. ..... 209/210; 209/211; 210/788; 210/512.1

[58] Field of Search ..... 210/788, 787, 512.2, 210/512.1; 209/211, 210

[56] References Cited

U.S. PATENT DOCUMENTS

| | | | |
|---|---|---|---|
| 2,590,691 | 3/1952 | Fontein | 209/173 |
| 2,794,832 | 6/1957 | Rietema | 210/512.2 |
| 2,829,771 | 4/1958 | Dahlstrom | 209/211 |
| 3,347,372 | 10/1967 | Bouchillon | 209/211 |
| 3,415,375 | 12/1968 | Wikdahl | 209/211 |
| 3,971,718 | 7/1976 | Reid | 210/788 |
| 4,297,111 | 10/1981 | Ross | 210/788 |

*Primary Examiner*—Joseph J. Rolla
*Assistant Examiner*—David H. Bollinger
*Attorney, Agent, or Firm*—William W. Habelt

[57] ABSTRACT

An improved method of centrifugally separating, cleaning or classifying solids contained in a fluid flow delivered to a hydrocyclone 2 through inlet 28 wherein the removal of unacceptable material, i.e. rejects, is enhanced and the loss of acceptable material in the rejects is reduced by introducing a secondary fluid having a solids content of less than about 0.2% by weight into the separating chamber 24 through inlet 38 in a substantially helical swirling flow pattern coaxially about the vortex formed by the solids containing flow. An additional flow of low-solids secondary fluid is introduced into a secondary separating chamber 64 disposed at the apex end of the hydrocyclone 2 to receive the rejects flow from the primary separating chamber 24.

4 Claims, 4 Drawing Figures

FIBER RECOVERY ELUTRIATING HYDROCYCLONE

BACKGROUND OF THE INVENTION

The present invention relates to improved apparatus for centrifugally separating, cleaning or classifying solids contained in a fluid mass delivered thereto and, more particularly, to an apparatus specifically adapted for increased fiber recovery from liquid pulp suspensions. Hereinafter, such apparatus shall be referred to as a hydrocyclone cleaner and any reference individually to cleaning, separating or classifying should be construed to include a reference to cleaning, separating and classifying collectively.

Hydrocyclone cleaners are well known in the art and have been utilized for many years for separating a desired solids component, typically termed accepts, such as pulp fibers, from a liquid suspension of solids, such as a suspension of pulp in water, containing not only accepts but also undesirable solids, such as dirt, clay particles, undivided fiber bundles, commonly termed shives, and bark, typically collectively termed rejects. One very common application of hydrocyclone cleaners is the processing of wood pulp for the paper making industry wherein the separator functions to segregate the lighter and relatively less dense useable fibers within the pulp suspension from the heavier and relatively more dense unusable fibers and foreign material, collectively referred to as rejects.

In a typical hydrocyclone cleaner, the solids containing liquid suspension, also commonly referred to as a slurry, moves through the cleaner in such a manner that counter flowing vortices are established within the cleaner. A free-type vortex pattern is established along the wall of the separating chamber of the cleaner while a forced vortex flow pattern is established about the central axis of the separating chamber of the cleaner radially inward of the free-type vortex. In a typical hydrocyclone cleaner having a conical separating chamber, the outer free-type vortex pattern migrates along the wall of the conical separating chamber towards the rejects outlet which is located at the apex of the conical separating chamber, while the inner forced vortex flow pattern migrates in the reverse direction along the axis of the conical separating chamber toward the base of the conical separating chamber to an accepts outlet opening coaxially through the base of the separating chamber. Generally, an outlet tube, typically called a vortex finder, extend through the base of the hydrocyclone into the separating chamber to open thereto for capturing the forced vortex flow of accepts material and directing same out of the hydrocyclone cleaner.

The majority of the separation of solids within the pulp slurry occurs in the conical separating chamber with any heavy or relatively more dense particles in the pulp slurry migrating to the wall of the separating chamber into the outer vortex flow to pass to and through the rejects outlet at the apex of the separating chamber, while most of the liquid and the light or relatively less dense solids make a turn in the lower region of the conical separating chamber to enter the inner forced vortex and flow back through the separating chamber in a rotating flow about the central axis of the hydrocyclone cleaner to the accepts outlet. Optimally, all useable pulp fibers should exit with the accepts material through the base end of the hydrocylone and all unusable material, such as dirt and bark, with the rejects flow through the apex end of the hydrocyclone. However, in practical operation, experience has been that in the case of conventional prior art hydrocyclone separators, a significant amount of useable fibers fail to enter the inner forced vortex and are discharged with the rejects material through the apex end of the hydrocyclone. Therefore, it has become necessary and customary in the industry to repeatedly reprocess the rejects flow from the hydrocyclone cleaner in an effort to regain additional useable material.

One attempt to provide a hydrocyclone separator which would more efficiently segregate acceptable useable fibers from the unacceptable rejects material is disclosed in U.S. Pat. No. 3,347,372 which was granted to Applicant on Oct. 17, 1967, and is commonly assigned to Applicant's assignee. The hydrocyclone separator disclosed therein is characterized by an elutriating chamber which is positioned intermediate the base end and the apex end of the hydrocyclone separating chamber. The elutriating chamber comprises a cylindrical section disposed in the conical separating chamber of the hydrocyclone intermediate the base and apex ends thereof into which a flow of supplemental water is introduced by way of openings in the side of the elutriating chamber. The openings are angled towards the apex end of the hydrocyclone so as to introduce the supplemental water in such a manner that the water joins the swirling free vortex which enters the cylindrical elutriating chamber from the conical separating chamber of the hydrocyclone. The supplemental water which enters the outer free vortex of the swirling flow passing from the conical separating chamber into the elutriating chamber displaces additional useable fibers from the outer vortex to the inner forced vortex where they are carried as described previously in counterflow to the base end of the cyclone separator to exit through the vortex finder.

It is an object of the present invention to provide an improved method of separating, cleaning or classifying solids contained in a fluid mass within a hydrocyclone via the injection of supplemental fluid to the hydrocyclone.

It is a further object of the present invention to provide a hydrocyclone cleaner specifically adapted to carry out the aforementioned improved method of separating, cleaning or classifying solids in a fluid supplied to the hydrocyclone.

SUMMARY OF THE INVENTION

The present invention provides an improved method of centrifugally separating, cleaning or classifying solids contained in a fluid flow delivered to a hydrocyclone of the type having an axially elongated substantially conical separating chamber with a rejects outlet at the apex end thereof and an accepts outlet at the base end thereof wherein the solids containing fluid flow is introduced through an inlet near the base end of the separating chamber in a substantially helical swirling flow pattern so as to establish within the conical separating chamber counter flowing inner and outer vortices. The improvement comprises introducing a secondary fluid flow having a solids content of less than about 0.2% by weight into the separating chamber of the hydrocyclone at the base end thereof in a substantially helical swirling flow pattern coaxially about the inner and outer vortices of a solids containing fluid so as to establish a boundary vortex along the wall of the separating chamber which rotates co-directionally with the outer vortex.

Further, a substantially conical secondary housing is provided coaxially about the apex end of the hydrocyclone so as to define an axially extending secondary separating chamber adapted to receive the rejects stream from the separating chamber of the hydrocyclone. An additional flow of the secondary fluid is introduced into the secondary separating chamber in a substantially helical swirling flow pattern coaxially about the rejects stream entering the secondary separating chamber so as to establish a boundary layer vortex along the wall of the secondary separating chamber which rotates co-directionally about the rejects stream entering the secondary separating chamber from the hydrocyclone. In this manner, a stable-quasi-laminer layer which also has a low solids content is established along the entire wall of both separating chambers. By providing a very dilute solids, stable layer along the walls of the separating chambers, dirt and unacceptable rejects material may more readily move to the outer vortex, and therefore not be entrained in the counterflowing forced inner vortex, than in a typical hydrocyclone wherein the outer vortex layer tends to thicken as the flow moves to the apex end in a conventional hydrocyclone. The rejects flow stream generated by the method of the present invention will have a much lower solids consistency than in conventional hydrocyclone cleaners but will recover a greater amount of dirt and unacceptable rejects material while recovering a greater percentage of useable acceptable fibers in the accepts flow.

Preferably, the secondary fluid, which has a solids content of less than about 0.2% by weight, is introduced into the separating chamber at a pressure of about the same magnitude as the pressure at which the solids containing fluid flow is introduced into the separating chamber.

Further in accordance with the present invention, there is provided a hydrocyclone for centrifugally separating, cleaning or classifying solids in accordance with the method of the present invention. The hydrocyclone comprises a primary housing defining an axially elongated separating chamber including a cylindrical bounding wall portion having a rejects outlet at the apex thereof defining a flow area through which the rejects stream exits the separating chamber and an accepts outlet at the opposite end thereof through which the accepts stream exits the separating chamber, and a secondary housing disposed about the apex end of the primary housing and extending axially therefrom to define a secondary separating chamber adapted to receive the rejects stream from the rejects outlet of the primary housing. An overflow tube is disposed coaxially within the primary housing at the base end thereof which opens to the separating chamber for receiving the accepts stream therefrom. A first inlet means is provided at the base end of the housing for introducing a solids containing fluid flow into the separating chamber in a substantially helical swirling flow pattern so as to establish within the separating chamber of the primary housing counterflowing inner and outer vortices inherently causing solids in the flow which are lighter and relatively less dense in size to move to the inner vortex and exit through the accepts outlet while causing solids in the fluid flow which are heavier and relatively more dense to move to the outer vortex. Additionally, a second inlet means is provided for introducing the secondary fluid flow into the separating chamber in a substantially helical swirling flow pattern coaxially about the inner and outer vortices of the solids containing fluid flow introduced through the first inlet means thereby establishing an additional vortex along the conical bounding wall of the primary housing rotating co-directionally with the outer vortex of the solids containing fluid flow.

A partition wall is disposed within the separating chamber coaxially about the overflow tube in space relationship between the bounding wall of the housing and the overflow tube so as to define a first annular inlet plenum intermediate the overflow tube and the partition wall into which the first inlet means opens and a second annular inlet plenum intermediate the partition wall and the bounding wall portion of the housing into which the second inlet means opens thereby providing a flow impervious boundary between the first annular inlet plenum into which the solids containing fluid is introduced and the second annular inlet plenum into which the second annular inlet plenum into which the secondary low-solids fluid flow is introduced so as to permit the establishment of independent coaxial vortices within the separating chamber. One or more third inlet means may be disposed in the bounding wall of the econdary housing, remote from the first and second inlet means, for introducing a flow of secondary low solids fluid into the secondary separating chamber in a substantially helical swirling flow pattern rotating co-directionally about the rejects stream received from the rejects outlet of the primary housing.

Preferably, the axially elongated separating chamber of the primary housing is formed of a first section defined by a substantially cylindrical bounding wall portion having an internal diameter, $D_c$, and a second section defined by a substantially conical bounding wall portion extending axially therefrom to a rejects outlet at its apex end, with the secondary housing having an opening in the base plate thereof for receiving the apex portion of the primary housing having a diameter ranging from about 0.3 $D_c$ to about 0.6 $D_c$. Further, it is preferred that the first inlet means for introducing the solids-containing fluid flow into the separating chamber and the second inlet means for introducing the secondary fluid flow into the separating chamber of the primary housing have a flow area opening to the separating chamber of about 0.03 the cross sectional flow area of the inlet section of the separating chamber.

BRIEF DESCRIPTION OF THE DRAWING

The present invention may be better understood and the unique features and advantages thereof made more evident from the following description of a preferred embodiment for carrying out the method of the present invention with reference to the accompanying drawing wherein.

DESCRIPTION OF A PREFERRED EMBODIMENT

Figure 1:
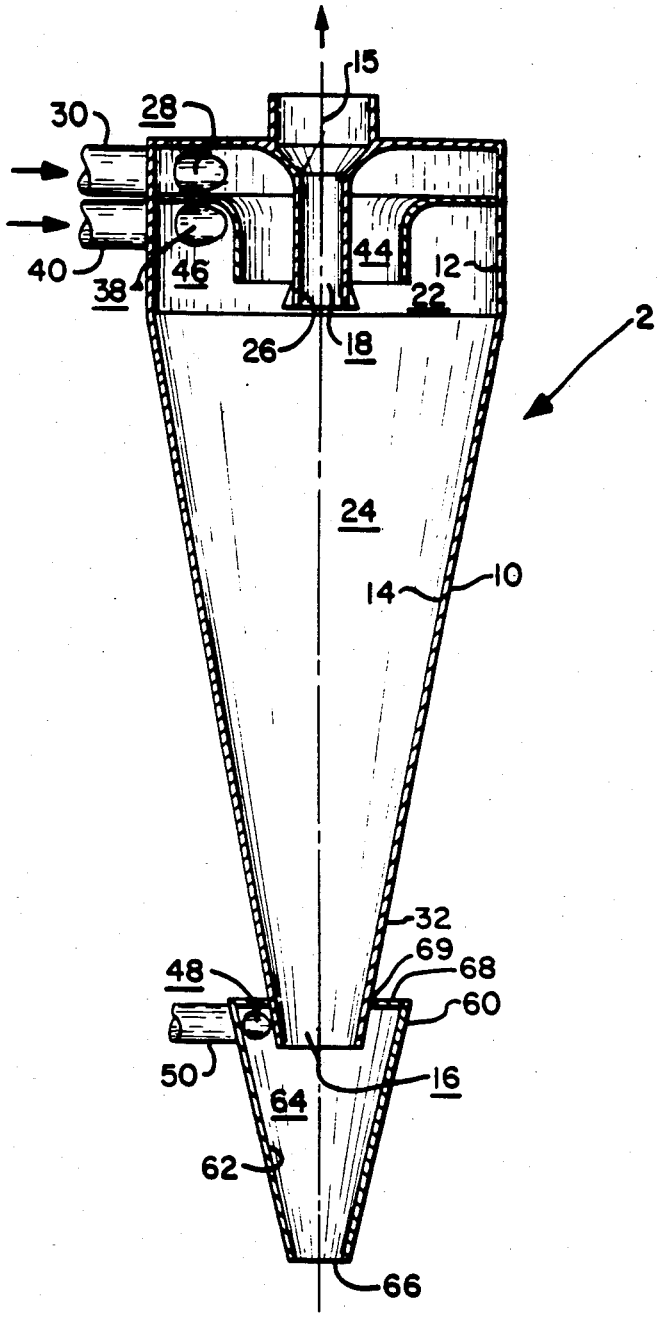
FIG. 1 is a cross-sectional, elevational view of a preferred embodiment of a hydrocyclone cleaner adapted for operation in accordance with the method of the present invention.

Referring now to the drawing, there is depicted therein a hydrocyclone cleaner 2 having an elongated tubular shell-like body 10 comprised of a first longitudinally extending cylindrical section 12 having a diameter $D_c$ and a second longitudinally extending substantially conical section 14 extending coaxially from the cylindrical section 12 and converging inwardly towards the central axis 15 of the housing 10. The housing 10 defines an axially elongated separating chamber having a inlet chamber 22 defined by the substantially cylindrical bounding wall portion of the first section 12 of the housing 10 and a primary separating chamber 24 defined by the conical section 14 which is a direct extension of the cylindrical section 12 and conically converges from a maximum diameter, $D_c$, at its base end adjacent the cylindrical selection 12 to a smaller diameter outlet opening 16 at the apex end of a conical section 14. Opposite of the outlet 16 at the apex end of the primary separating chamber 24 is a coaxially aligned outlet 18 opening to the primary separating chamber 24 at the base end of the housing 10. Preferably, as shown in the drawing, the outlet 18 opens into an overflow tube 26 which opens to the primary separating chamber 24 and extends axially back through the inlet chamber 22 to pass out of the housing 10 at the base of the cylindrical section 12. The overflow tube 26 serves as a vortex finder to assist in conducting the forced vortex containing the accepts flow from the primary separating chamber 24 through the inlet chamber 22 to a location exterior of the hydrocyclone cleaner housing 10.

An inlet opening 28 is located in the cylindrical bounding wall of the first section 12 of the housing 10 to provide an opening into the inlet chamber 22 adjacent the base end of the hydrocyclone cleaner housing 10. A supply tube 30 is connected to the inlet opening 28 through which the solids-containing liquid suspension or slurry to be processed is passed into the inlet chamber 22 of the separating chamber in a substantially helical swirling flow pattern so as to establish counterflowing inner and outer flowing vortices within the primary separating chamber 24.

In operation, the solids-containing fluid flow, typically having a solids content ranging from about 0.5 to about 3.0 percent by weight, is pumped under pressure, typically in the range of 15 to 20 psig, from a supply tank through supply pipe 30 into the inlet chamber 22 through the tangential inlet 28 in the cylindrical bounding wall of the first section 12 of the housing 10. As the liquid suspension moves through the inlet chamber 22, it travels a downward helical path about the vortex tube 26 to enter the primary separating chamber 24. The solids containing suspension or slurry flows through the primary separating chamber 24 in free-type vortex flow pattern along a helical path near the wall elongated truncated conical section 14 of the housing 10 to the apex end thereof. As a result of the swirling flow pattern and resultant centrifugal forces in the vortex flow, a region of low pressure is generated along the central axis 15 of the hydrocyclone. This low pressure zone is filled either with air or a vapor phase of the liquid flowing through the hydrocyclone and is classically referred to as the air or vapor core. As the solids containing fluid suspension flowing downwardly in the free-type vortex approaches the central axis 15 of the hydrocyclone at the apex end of the elongated truncated conical section 14, a counterflowing forced vortex is formed in the primary separating chamber 24 which passes back through the primary separating chamber 24 about the air or vapor core formed along the central axis 15 of the housing 10 to the accepts outlet 18 which opens to the separating chamber 24 at the end of the vortex tube 26.

The forces generated in the counterflowing vortex flow of the liquid suspension or slurry passing through the separating chamber 24 results in a desired separation of solids in the liquid slurry or suspension. The relatively light and less dense particles in the liquid suspension flowing through the primary separating chamber 24 are entrained in the counterflow forced inner vortex and are conducted thereby out of the separating chamber 24 through the accepts outlet 18. Conversely, the rejects stream, i.e., the relatively heavy and dense particles in a liquid suspension or slurry, are entrained in the outer free vortex and flow out of the outlet 16 at the apex end of the primary separating chamber 24.

The outer vortex flow being a free-type vortex increases in velocity as it progresses along the inwardly tapering walls of the substantially conical section 14 of the housing 10 towards rejects outlet 16 at the apex end of the truncated conical portion 14. This increase in flow velocity as the vortex approaches the apex end of the conical separating chamber gives rise to the centrifugal forces within the solids-containing fluid flow which provide for the separation of the solids therein into an accepts and a rejects portion. The accepts solids in the suspension or slurry migrate under these forces towards the central axis 15 of the hydrocyclone cleaner 10 to be entrained in the forced counterflowing vortex and passed back along the central axis 15 to the accepts outlet 18. The rejects solids migrate to the outer wall of the elongated conical section 14 and are carried in the free-type vortex to the rejects end of the conical separating chamber.

However, as the separating chamber 24 reduces in cross-sectional area by virtue of the inwardly sloping walls of the elongated conical section 14 in the housing 10, the rejects solids migrating to the outer boundaries of the free outer vortex are crowded together resulting in a thickening of the fluid flow in the outer regions of the free outer vortex. As a result it becomes more difficult for rejects solids to migrate to the outer regions of the free-type vortex and pass through the rejects outlet. Consequently, a portion of the rejects solids do not successfully migrate to the outer regions of the free outer vortex but rather will be caught up in the forced inner vortex together with acceptable solids and pass back axially through the separating chamber 24 to the accepts outlet. In order to minimize the entrainment of rejects solids in the accepts stream, it is customary to truncate the primary separating chamber at a diameter large enough to minimize entrainment of the rejects material in the accepts streams. However, as a result of such premature truncation of the primary separating chamber, a not insignificant amount of acceptable material will remain in the free outer vortex and pass through the rejects outlet 18 at the apex end of the truncated cylindrical section 14 which in turn necessitates one or more reprocessing of the rejects stream to recover additional accepts material.

In order to reduce the undesirable entrainment of rejects material in the accepts flow and accepts material in the rejects flow in accordance with the present invention, a secondary fluid flow having a solids content of less than about 0.2% by weight is introduced into the separating chamber of the hydrocyclone at the base end thereof in a substantially helical swirling coaxially about the inner and outer vortices of the solids containing fluid so as to establish a boundary layer vortex along the conical bounding wall of the second section of the separating chamber 24. Second inlet means 38 is provided at the base end of the housing 10 near the first inlet means 28 to the primary separating chamber 24 for introducing the secondary fluid flow into the inlet section 22 of the separating chamber 24. The secondary fluid flow is introduced through the second inlet means 38 into the inlet chamber 22 in a substantially helical swirling flow pattern coaxially about the inner and outer vortices of the solids containing fluid flow introduced into the inlet chamber 22 through the first inlet means 28. The secondary fluid flow establishes an additional vortex of low solids along the conical bounding wall of the second portion 14 of the housing 10 rotating co-directionally with the outer vortex of the solids containing fluid passing through the separating chamber 24. Solids in the outer vortex which are relatively heavy and more dense preferentially move into the additional low-solids vortex established along the conical bounding wall of the second section 14 of the separating chamber 24 and pass therealong to exit through the rejects outlet 16 at the apex end 32 of the housing 10. Consequently, a greater amount of rejects material passes out of the outlet 16 than in conventional hydrocyclones and less rejects material is entrained in the inner vortex flowing back along the central axis 15 of the hydrocyclone from the apex end 32 to the accepts outlet 18.

A partition wall 42 is disposed within the inlet section 22 of the separating chamber 24 coaxially about the overflow tube 26 in spaced relationship between the cylindrical bounding wall portion 12 of the housing 10 and the overflow tube 26 so as to divide the inlet chamber 22 into a first annular inlet plenum 44 intermediate the overflow tube 26 and the partition wall 42 into which the first inlet means 28 opens, and a second annular inlet plenum 46 intermediate the partition wall 42 and the cylindrical bounding wall portion 12 of the housing 10 into which the second inlet means 38 opens. This partition wall 42 provides a flow impervious boundary between the first annular inlet plenum 44 and the second annular inlet plenum 46 so that the solids containing fluid flow and the low solids secondary fluid do not immediately contact each other upon introduction into the inlet chamber 22 thereby providing the opportunity for the vortical flows of the two fluids to be established before the fluid flows pass into the conical portion 14 in the separating chamber 24.

Figure 2:
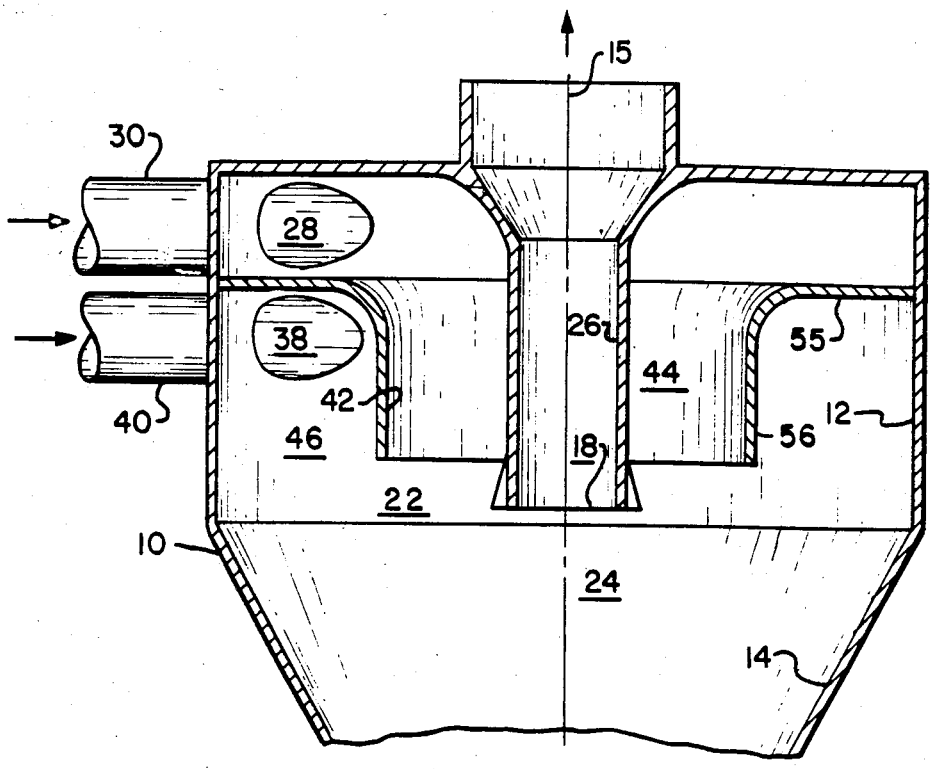
FIG. 2 is an enlarged cross-sectional, elevational view of the inlet section of the primary housing of the hydrocyclone of FIG. 1.
Figure 4:
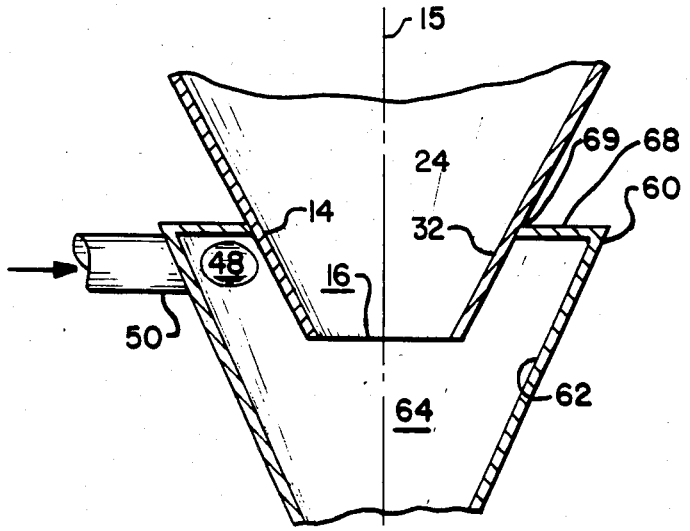
FIG. 4 is an enlarged cross-sectional, elevational view of the base section of the secondary housing of the hydrocyclone cleaner of FIG. 1.

In the embodiment shown in FIGS. 1 and 2, the partition wall 42 is comprised of a disk-like plate 55 mounted to the cylindrical bounding wall portion 12 of the housing 10 intermediate the first inlet means 28 and the second inlet means 38 both of which are located in adjacent relationship in a common wall. The plate 55 extends radially inwardly therefrom to a cylindrical portion 56 thereof which extends coaxially about the overflow tube 26 in space relationship therewith towards the conical portion 14 of the separating chamber 24. The cylindrical extension 56 of the partition means 42 need not extend the entire distance from the disk-like plate portion 55 of the partition means 42 to the interface of the cylindrical bounding wall portion 12 of the housing 10 with the conical bounding wall 14 of the housing 10 but may be truncated upstream of the interface so long as sufficient length is provided so as to permit the establishment of an independent low solids outer vortex coaxially about vortical flow of the solids-containing fluid passing through the first inlet plenum 44.

Figure 3:
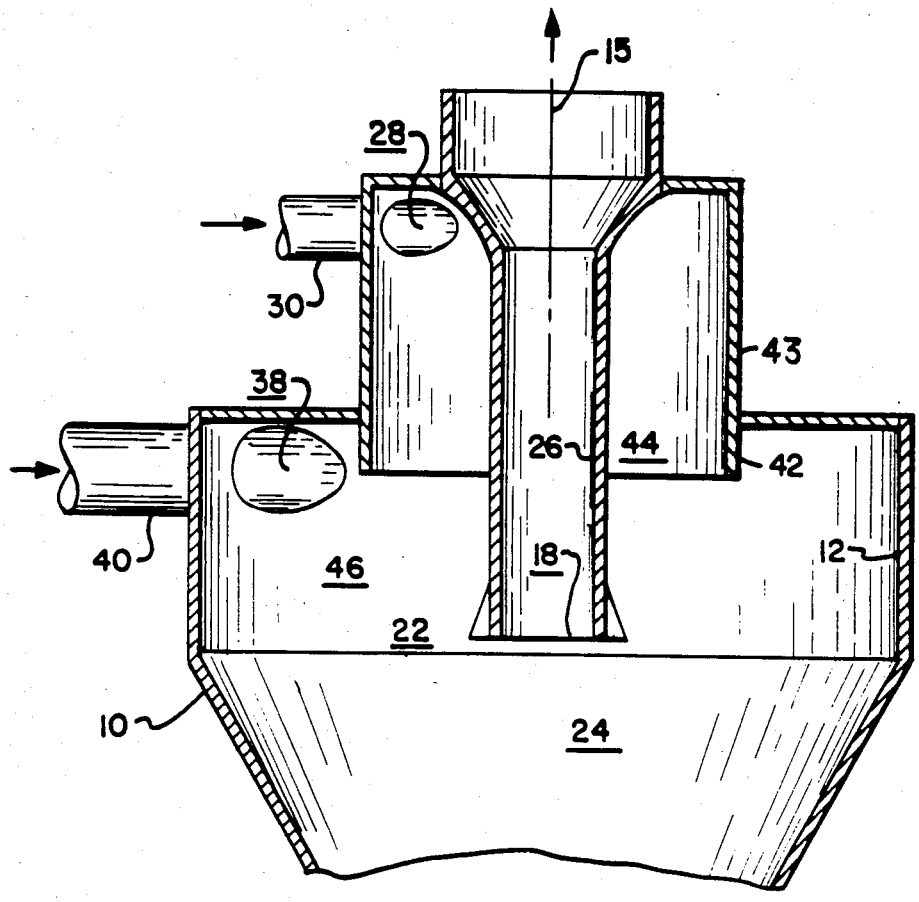
FIG. 3 is an enlarged cross-sectional elevational view of an alternate embodiment of the inlet section of the primary housing of the hydrocyclone of FIG. 1.

In the embodiment shown in FIG. 3, the partition wall 42 comprises a cylindrical shell 43 coaxially about the overflow tube 26 in space relationship therewith. The cylindrical shell 43 is mounted to the base of the housing 10 in coaxial relationship with the cylindrical bounding wall portion 12. The diameter of the cylindrical shell 43 is less than the diameter of the cylindrical portion 12 of the housing 10 and is disposed such that the lower portion of the shell 43 extends through the base of the housing 10 to form the partition wall 42 which serves to maintain initial separation of the vortex flow of the solids containing fluid flow, introduced through the first inlet means 28 in the shell 43 and passing through the first inlet plenum 44, and the flow of the low solids secondary fluid introduced through the second inlet means 38 in the cylindrical bounding wall portion 12 so that the two vertical flows may be independently established.

Further in accordance with the present invention, a substantially conical secondary housing 60 is disposed coaxially about the apex end 32 of the housing 10 to receive the rejects stream from the rejects outlet 16 of the primary separating chamber 24. The secondary housing 60 defines an axially extending secondary separating chamber through which the rejects flow passing from the rejects outlet 16 of the primary separating chamber 24 must traverse to reach the rejects outlet 66 of the secondary housing 60 disposed coaxially downstream from the rejects outlet 16 of the primary separating chamber 24. The top plate 68 of the secondary housing 60 has a centrally disposed opening 69 therein for receiving the apex end 32 of the primary housing 10. For optimal performance, it is preferred that the opening 69 in the top plate 68 of the secondary housing 60 have a diameter ranging from about 0.3 to about 0.6 times the internal diameter, $D_c$, of the substantially cylindrical first section 12 of the housing 10 which defines the inlet chamber 22.

A third inlet means 48 is provided in the bounding wall 62 of the secondary housing 60 adjacent the top plate 68 thereof for introducing secondary fluid into the secondary separating chamber 64, preferably at a pressure having a magnitude ranging from about 70% to about 110% of the pressure at which the solids-containing fluid flow is delivered to the inlet chamber 22. The low-solids secondary fluid passes through the third inlet means 48 from the supply pipe 50 to enter the secondary separating chamber 64 in a substantially helical swirling flow pattern rotating co-directionally about the rejects stream flow received from the rejects outlet 16 of the primary separating chamber 24 so as to establish a boundary layer vortical flow along the conical bounding wall 62 of the secondary separating chamber 24 rotating co-directionally with the vortical flow of rejects fluid through the secondary separating chamber 64. As a relatively low-solids boundary vortex will exist along the wall 62 of the secondary separating chamber 64, the relatively heavy and more dense material in the rejects stream 16 will preferentially pass outwardly into the boundary layer vortex and be carried to the rejects outlet 66 of the secondary separating chamber 64 while the lighter and relatively less dense acceptable material in the rejects stream 16 will turn and pass axially back through the secondary separating chamber 64, through the rejects outlet 16, and along with the accepts flow of the primary separating chamber 24, to the accepts outlet 18 of the overflow tube 26. In this manner, additional acceptable material will be removed from the rejects stream and additional rejects material concentrated in the rejects stream leaving the rejects outlet 66 of the secondary separating chamber 24.

Laboratory tests of hydrocyclones designed in accordance with the teachings of the present invention have shown a substantial improvement in shive removal efficiency over conventional hydrocyclones and a competitive dirt removal efficiency. Additionally, efficiencies of removal of fibers from the rejects stream of 90% and greater were obtained, this efficiency being based on a comparison of the fiber content of the rejects stream to the fiber content of the solids feed stream.

Further, it has been found that performance of the hydrocyclone cleaner of the present invention can be optimized by properly selecting the inlet flow areas of the first and second inlet means, and the pressures of the secondary fluid and the solids-containing fluid introduced to the primary separating chamber. Preferably, the the first inlet means 28 and the second inlet means 38 to the first section 12 of the primary housing 10 defining the inlet chamber 22 each have an outlet flow area of about 0.03 times the internal cross-sectional flow area A, of the substantially cylindrical first section 12 of the primary housing 10. Further, it is preferred that the secondary fluid be introduced into the inlet chamber 22 of the primary housing 10 about the same magnitude as the pressure at which the solids containing fluid is introduced into the inlet chamber 22 and, most preferably, in the range from at least 80% to about 120% that magnitude.

While the present invention has been described and illustrated herein in relationship to the specific embodiment shown in the drawing, it is to be understood that the specific embodiment shown in the drawing is merely illustrative of the best mode presently contemplated for carrying out the method of the present invention. Accordingly, it is intended that any modification which is apparent to those skilled in the art in light of the foregoing description and which falls within the spirit and scope of the appended claims be included in the invention as recited in the appended claims.

I claim:

1. An improved method of centrifugally separating, cleaning or classifying solids contained in a fluid flow delivered to a hydrocyclone of the type having an axially elongated substantially conical separating chamber having an axially aligned rejects outlet at the apex end thereof and an axially aligned accepts outlet at the base end thereof wherein the solids containing fluid flow is introduced through an inlet means at the base end of the separating chamber in a substantially helical swirling flow pattern so as to establish within the conical separating chamber counterflowing inner and outer vortices inherently causing solids in the fluid flow which are lighter and relatively less dense to move to the inner vortex and exit through the accepts outlet as an accepts stream while causing solids in the fluid flow which are heavier and relatively more dense to move to the outer vortex and exit through the rejects outlet as an rejects stream, the improvement comprising:

a. introducing a secondary fluid flow having a solids content of less than about 0.2% by weight into the separating chamber of the hydrocyclone at the base end thereof in a substantially helical swirling flow pattern coaxially about the inner and outer vortices of the solids containing fluid flow so as to establish a reduced solids content boundary layer vortex along the wall of separating chamber rotating co-directionally with the outer vortex;

b. providing a substantially conical secondary housing coaxially about the apex end of the hydrocyclone defining an axially extending secondary separating chamber adapted to receive the rejects stream from the separating chamber of the hydrocyclone and having a rejects outlet at the apex end thereof through which the rejects stream exists the secondary separating chamber; and c. introducing an additional flow of the secondary fluid into the secondary separating chamber in a substantially helical swirling flow pattern coaxially about the rejects stream entering the secondary separating chamber so as to establish a reduced solids content boundary layer vortex along the wall of the secondary separating chamber rotating co-directionally with the rejects stream entering the secondary separating chamber.

2. A method as recited in claim 1 further comprising introducing the secondary fluid into the separating chamber at a pressure of about the same magnitude as that of the pressure at which the solids containing fluid flow is introduced into the separating chamber.

3. A method as recited in claim 1 wherein the secondary fluid is introduced into the separating chamber at a pressure ranging from at least about 80% to about 120% the magnitude of the pressure at which the solids containing fluid flow is introduced into the separating chamber.

4. A method as recited in claim 1 wherein the solids containing fluid flow fed to the separating chamber has a solids content ranging from about 0.5 to about 3.0 percent by weight and the ratio of the solids content of the rejects stream leaving the separating chamber to the solids content of the solids containing fluid flow fed to the separating chamber ranges from about 0.5 to about 1.0 to 1.

* * * * *